US006460218B2

(12) United States Patent
Zingg

(10) Patent No.: US 6,460,218 B2
(45) Date of Patent: Oct. 8, 2002

(54) RUNNING CARRIAGE ARRANGEMENT FOR A SLIDING DOOR

(75) Inventor: Heinz Zingg, Niederuzwil (CH)

(73) Assignee: EKU AG, Sirnach (CH)

( * ) Notice: Subject to any disclaimer, the term of this patent is extended or adjusted under 35 U.S.C. 154(b) by 0 days.

(21) Appl. No.: 09/734,131

(22) Filed: Dec. 11, 2000

(65) Prior Publication Data

US 2001/0003855 A1 Jun. 21, 2001

(30) Foreign Application Priority Data

Dec. 13, 1999 (CH) ..... 02285/99

(51) Int. Cl.[7] ..... E05D 15/16
(52) U.S. Cl. ..... 16/105; 16/97; 16/99
(58) Field of Search ..... 16/105, 99, 97, 16/87 R, 87.4 R, 87.2; 49/420, 421, 425; 160/345–347

(56) References Cited

U.S. PATENT DOCUMENTS 3,041,657 A * 7/1962 McNinch ..... 16/105
3,142,859 A * 8/1964 Suska ..... 16/105
4,386,447 A * 6/1983 Baus ..... 16/105
4,559,670 A * 12/1985 Wyatt ..... 16/87.2
4,964,191 A * 10/1990 Wyatt ..... 16/87.2
5,404,675 A * 4/1995 Schmidhauser ..... 16/87.4 R
6,052,867 A * 4/2000 Haab et al. ..... 16/87 R
6,185,784 B1 * 2/2001 Gamperle ..... 16/105

FOREIGN PATENT DOCUMENTS

EP 0 814 226 A1 12/1997

* cited by examiner

*Primary Examiner*—Chuck Y. Mah
(74) *Attorney, Agent, or Firm*—Akin, Gump, Strauss, Hauer & Feld, L.L.P.

(57) ABSTRACT

A running carriage arrangement (1) includes a housing receptacle (5) and a housing (9) embedded in it. The running carriage (7) can be vertically shifted within the housing (9). The shifting of the running carriage (7) is accomplished by an adjusting wheel (39), which can be rotated by hand and by which the running carriage (7) can be adjusted relative to the housing (9) and the sliding door (3).

8 Claims, 2 Drawing Sheets

RUNNING CARRIAGE ARRANGEMENT FOR A SLIDING DOOR

BACKGROUND OF THE INVENTION

The present invention relates to a running carriage arrangement for a sliding door, containing a housing receptacle to be inserted into a cup bore on the sliding door, a housing to be inserted in the housing receptacle, a running carriage with rollers or slides, and mechanisms for shifting and adjusting the running carriage, wherein this running carriage can be shifted and adjusted vertically relative to the housing Running carriage arrangements for sliding doors are known in many diverse embodiments in the prior art. One such known embodiment includes a housing receptacle, which can be inserted in a cup bore hole on the upper edge of the sliding door and affixed to the sliding door using threaded bolts or the like. In the central, largely circular ring-shaped receptacle part, a disk segment-shaped housing is inserted, on whose upper side the running carriage is affixed. The running carriage can consist of slides or, for higher-quality embodiments, of one or two roller pairs, which are designed for the purpose of rolling along in a guide rail.

In European published patent application EP 0 814 226 an additional running carriage arrangement is described, which has a housing with lateral, parallel flanks, that is guided vertically in the housing receptacle with corresponding parallel running guide surfaces. Using an eccentric disk, which is held rotatably on the housing receptacle and engages into a slot-shaped opening in the running carriage housing, the running carriage housing can be shifted vertically and thus adjust the vertical position of the sliding door relative to the guide rail. This device achieves the purpose of vertical adjustability for which it is intended.

However, for the adjustment a tool is necessary, since to rotate the eccentric disk large torques are necessary, depending on the weight of the sliding door, in order to be able to overcome the frictional forces in the slot-shaped opening. This also necessitates that the eccentric disk and the slot-shaped opening be manufactured from a high-quality material. On the other hand, it is not ensured that through vibrations the position of the eccentric disk can change and thereby change the position of the sliding door.

SUMMARY OF THE INVENTION

An object of the present invention is to create a running carriage arrangement with a vertical adjustment device having a large possible lift path and operability that does not require a tool.

This object is achieved by a running carriage arrangement of the type described at the outset wherein, for the vertical adjustment of the running carriage in the housing, a threaded bolt is used and an adjusting wheel is set on it. The adjusting wheel lies in a recess of the support of the running carriage, which can be shifted vertically in the housing, and the adjusting wheel can be rotated from outside of the housing.

Using a ribbed adjustment wheel, partially projecting out of the housing receptacle, the sliding door can be easily adjusted by hand after its installation, without the operating person having to force himself into the cabinet and without a tool having to be laboriously introduced "blindly" into an eccentric disk. The adjustment can, as a result, be performed from the outside by grasping the sliding door from behind and actuating the adjustment wheel by hand, while at the same time observing the adjustment of the sliding door.

The running carriage arrangement according to the invention can be manufactured in a very cost-effective manner, and the parts necessary for the adjustment, which are heavily loaded by the weight of the sliding door, include a threaded rod, e.g., a commercially available threaded bolt, and the adjustment wheel, which can be a commercially available or slightly modified threaded bolt nut. This adjustment mechanism is self-locking. After the adjustment to the desired position, under normal usage conditions, there is no troublesome change of the position once it is assumed. Under rough usage conditions with heavy vibrations, the adjustment wheel can be held in its position by additional fixed adjustment or holding mechanisms.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
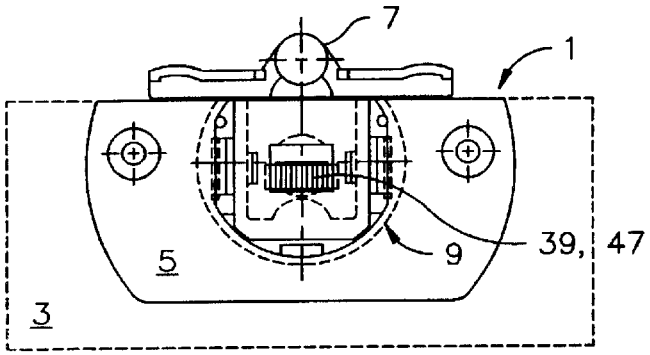
FIG. 1 is a front view of a running carriage arrangement of the invention.

The running carriage arrangement 1 depicted in FIG. 1 for installation in a sliding door 3 includes a housing receptacle 5, a running carriage 7 and a housing 9, which receives the running carriage 7 so that it can shift vertically and which is inserted in the housing receptacle 5.

The housing receptacle 5 includes a mounting plate 11 with two attachment bore holes 13, through which the housing receptacle 5 can be affixed in a cup bore to the sliding door 3 using screws. The mounting plate 11 has a collar 15 in the center, which is designed for the purpose of engaging into the cup bore in the sliding door 3 and thus for guiding the housing receptacle 5 free from play on the sliding door 3. Inside the collar 15 four guide surfaces 17 are constructed, whose flanks lie opposite each other in pairs and in parallel and function as a lateral guide of flanks 19 that likewise lie parallel on the housing 9. In the center of the flanks 19 catch mechanisms 21, e.g., elastically constructed catch tappets, are mounted which catch on correspondingly constructed catch elements 23, when the housing 9 is inserted axially into the housing receptacle 5. In addition, the housing 9 contains two guide flanks 24 lying parallel, which function for the guidance of the running carriage support 25 on the running carriage 7. The running carriage 7 in the present embodiment is a roller carriage with a roller pair 29, which is held by its axle (not shown) engaged in the recess 31. Lateral braking and/or retaining shoes 33 can be molded onto the running carriage7.

A threaded rod, in the present embodiment a threaded bolt 35 with a threaded bolt head 37, can be set into the housing 9 and is designed to come into engagement with the running carriage 7. The threaded bolt head 37 comes to lie in a recess 30 in the housing 9 and is held there so that it is rotationally fixed. On the threaded bolt 35 sits an adjustment wheel 39, which intermeshes with the threads of the threaded bolt 35. Alternatively, the adjustment wheel 39 can be connected affixed to the threaded rod 35. The upper or lower end of the threaded rod 35 is guided in this embodiment (no drawing) in a threaded bore on the running carriage support 25 or on the housing 9.

Figure 8:
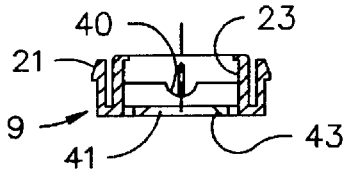
FIG. 8 is a horizontal section through the running carriage support.
Figure 2:
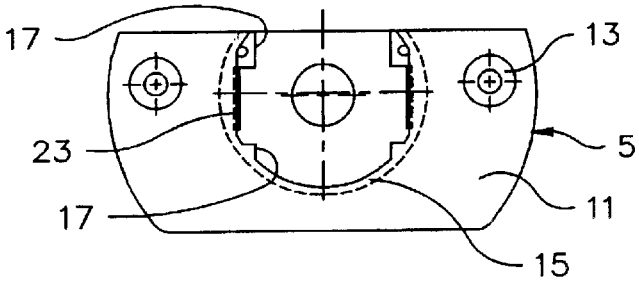
FIG. 2 is a front view of a housing receptacle of the invention.
Figure 3:
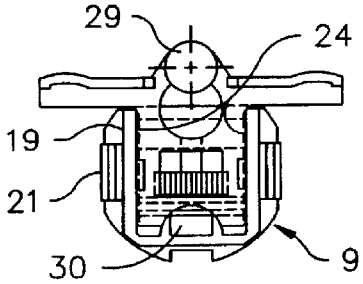
FIG. 3 is a front view of the housing with the running carriage fitted into it.
Figure 4:
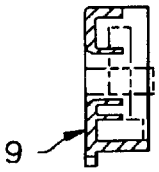
FIG. 4 is a vertical section through the housing with inserted threaded bolt.
Figure 5:
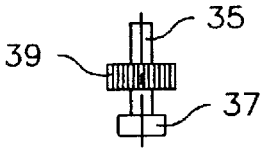
FIG. 5 is the threaded bolt with an adjustment wheel.
Figure 6:
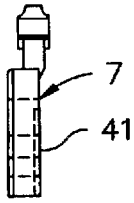
FIG. 6 is a longitudinal section through the running carriage support without rollers.
Figure 7:
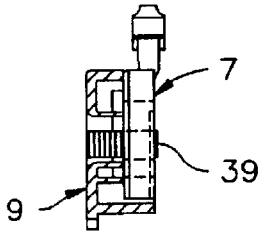
FIG. 7 is a vertical section through the housing as shown in FIG. 4 with additionally fitted running carriage support.
Figure 9:
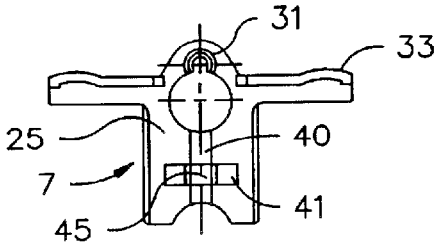
FIG. 9 is a front view of the running carriage without rollers.
Figure 10:
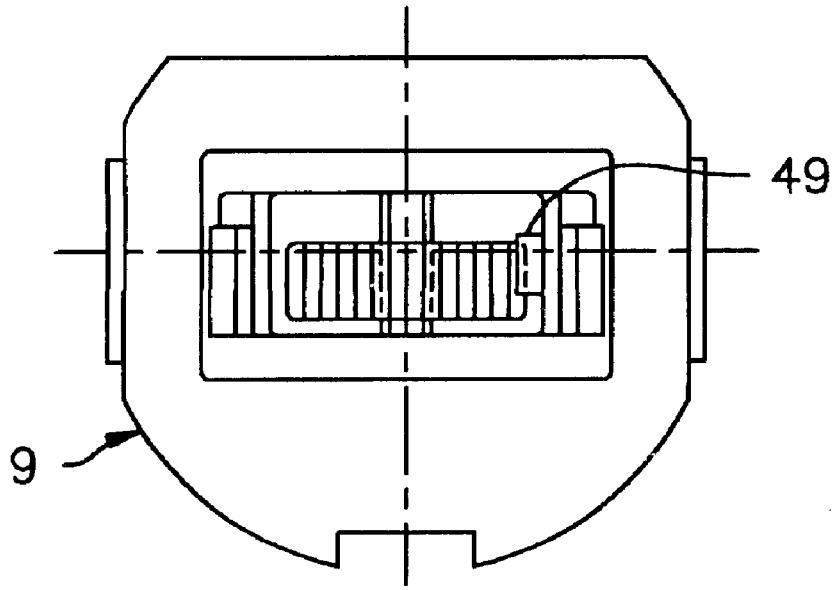
FIG. 10 is a front view of the housing with a spring catch.
Figure 11:
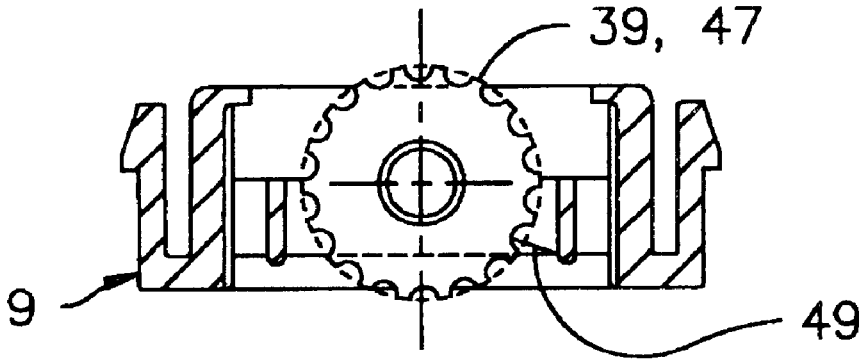
FIG. 11 is a horizontal section of the housing with spring catch.

The adjustment wheel 39 penetrates the running carriage support 25 in an opening 41 and can project beyond its surface by a slight amount or, as shown in FIG. 7, can lie in a conically running recess 43 (FIG. 8). The threaded bolt 35 is guided in a threaded rod guide 40 between the running carriage 7 and the housing 9, as soon as the housing 9 has been inserted into the housing receptacle 5, with the running carriage support 25 arranged so that it can be shifted in the housing, and has been affixed by the catch mechanisms 21.

In the following, the running carriage arrangement 1 is explained briefly. After the assembly without tools, i.e., sliding together the individual parts and the installation into the sliding door 3, the running carriage 7 can be shifted vertically relative to sliding door 3 by rotating the adjusting wheel 39. When the sliding door 3 is suspended on a cabinet (not shown), the running carriage 7 lies with the lower surface 45 of the opening 41 on the underside of the adjusting wheel 39. By rotating the adjusting wheel 39, it moves in the axial direction on the shaft of the threaded bolt 35. In this way, the sliding door 3 can be lifted or lowered. The actuation of the adjusting wheel 39 is done without tools using a finger, preferably with the thumb, which gets a good hold on a periphery of the ribbing 47 provided on the adjusting wheel 39. By a spring catch 49 engaging in the ribbing 47 of the adjusting wheel 39, a further rotation of the adjusting wheel 39 due to disturbing vibrations can be prevented after setting the desired position.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A running carriage arrangement (1) for a sliding door (3), comprising a housing receptacle (5) for insertion into a cup bore on the sliding door (3), a housing (9) for insertion into the housing receptacle (5), and a running carriage (7) with rollers or slides, the running carriage (7) having a support (25) which is vertically shiftable and adjustable relative to the housing (9), the housing (9) having a threaded rod (35) with an adjusting wheel (39) mounted on the threaded rod (35) to provide vertical adjustment of the support (25) and running carriage (7) relative to the housing (9), the adjusting wheel (39) lying in a recess (41) of the support (25), and the adjusting wheel (39) being accessible for rotation from outside of the housing (9).

2. The running carriage arrangement according to claim 1, wherein the adjusting wheel (39) is mounted so that it is rotationally fixed to the threaded rod (35) and the threaded rod (35) is guided in a threaded bore in the support (25) or in the housing (9).

3. The running carriage arrangement according to claim 1, wherein a threaded rod guide (40) is provided in the support (25), the guide (40) forming a pivot bearing for the threaded rod (35).

4. The running carriage arrangement according to claim 1, wherein the threaded rod (35) is constructed as a threaded bolt having a head (37) connected to the housing (9) so that the threaded rod (35) is rotationally fixed, the adjusting wheel (39) is mounted so that it can rotate on threads of the threaded rod (35), and the adjusting wheel (39) projects through the recess (41) to carry the support (25) of the running carriage (7).

5. The running carriage arrangement according to claim 4, wherein the housing (9) is axially shiftable in the housing receptacle (5) and is constructed to be lockable by at least one catch mechanism (21).

6. The running carriage arrangement according to claim 4, wherein guide surfaces (23) are provided running vertically in the housing (9) to guide the support (25).

7. The running carriage arrangement according to claim 6, wherein a recess (30) is formed in the housing (9) for the rotationally fixed holding of the threaded rod (35).

8. The running carriage arrangement according to claim 1, wherein a spring catch (49) affixed on at least one of the housing (9) and the housing receptacle (5) meshes in ribbing (47) on the adjusting wheel (39).

* * * * *